US005365146A

United States Patent [19]

Kadwell

[11] Patent Number: 5,365,146

[45] Date of Patent: Nov. 15, 1994

[54] CONTROL DEVICE HAVING AN OSCILLATOR UNIT THAT PULSES A DIRECT CURRENT THROUGH THE FILAMENTS OF THE VACUUM FLUORESCENT DISPLAY UNIT THEREOF AND METHODS OF MAKING THE SAME

[75] Inventor: Brian J. Kadwell, Holland, Mich.

[73] Assignee: Robertshaw Controls Company, Richmond, Va.

[21] Appl. No.: 4,702

[22] Filed: Jan. 14, 1993

[51] Int. Cl.[5] ..... H05B 39/00

[52] U.S. Cl. ..... 315/94; 315/169.1; 315/169.4; 315/209 R

[58] Field of Search ..... 315/94, 169.1, 169.3, 315/169.4, 209 R, 227 R, 247, 344, 349; 331/111, 176

[56] References Cited

U.S. PATENT DOCUMENTS 4,495,445 1/1985 Turney ..... 315/169.1

4,704,560 11/1987 Mills et al. ..... 315/169.3

*Primary Examiner*—Robert J. Pascal
*Assistant Examiner*—Haissa Philogene
*Attorney, Agent, or Firm*—Candor, Candor & Tassone

[57] ABSTRACT

A control device and methods of making and operating the same are provided, the control device comprising a microcomputer unit, a vacuum fluorescent display unit having a filament unit, a power supply unit for being interconnected to a high voltage alternating current power supply that has a certain frequency, and a circuit operatively interconnecting the units together, the power supply unit comprising a transformerless capacitor arrangement for creating a low voltage direct current from the power source to power the microcomputer unit, the circuit comprising an oscillator unit that receives the direct current and pulses the same through the filament unit at a frequency that is greater than the certain frequency and that causes the filament unit to heat to an operating temperature thereof.

12 Claims, 6 Drawing Sheets

| OPTION | OUT | IN |
|---|---|---|
| D8 | BEEP @ 1 MINUTE SHOW SECONDS | NO BEEP 1 MINUTE |
| D9 | CONTINUOUS E.O.C. | AUTO-STOP E.O.C. |
| D10 | SLEW | ROTARY |
| D11 | 60 HZ | 50 HZ |
| D12 | REGULAR SLEW | TURBO SLEW |
| D13 | 12:00 CLOCK | 24:00 CLOCK |
| W3 | MANUAL DISPLAY PRIORITY | AUTO DISPLAY PRIORITY |
| W3/D10/ D12 | NOT APPLICABLE | ONE BUTTON ROTARY |

CONTROL DEVICE HAVING AN OSCILLATOR UNIT THAT PULSES A DIRECT CURRENT THROUGH THE FILAMENTS OF THE VACUUM FLUORESCENT DISPLAY UNIT THEREOF AND METHODS OF MAKING THE SAME

BACKGROUND OF THE INVENTION

1. Field of the Invention

This invention relates to a new control device, such as a clock and/or a timer, as well as to new methods of making and operating such a control device.

2. Prior Art Statement

It is known to provide a control device comprising a microcomputer unit, a vacuum fluorescent display unit having filament means, a power supply unit for being interconnected to a high voltage alternating current power supply means that has a certain frequency, and circuit means operatively interconnecting the units together, the power supply unit comprising a transformerless capacitor arrangement for creating a low voltage direct current from the power source means to power the microcomputer unit, the filament means being disposed in series with the capacitor of the capacitor arrangement so that a direct current is pulsed through the filament means at the same frequency as the certain frequency of the high voltage alternating current power supply means so as to heat the filament means to an operating temperature thereof.

It is also known to provide a direct current to power a microcomputer unit utilizing resistance means interconnected to the high voltage alternating current power supply means.

It is also known to utilize a pair of transistors each having a base emitter junction and being connected in parallel together with an oscillator transistor connected between the base emitter junctions of said first pair of transistors and one side of the capacitor so that the oscillator transistor will cause the turning on and off of the pair of transistors at a certain frequency so as to provide an oscillator unit. However, applicant believes that such oscillator means has never been used to heat a filament means of a vacuum fluorescent display unit of a control device.

SUMMARY OF THE INVENTION

It is one of the features of this invention to provide a new control device wherein unique means are provided for operating the vacuum fluorescent display unit thereof by utilizing a transformerless capacitor arrangement for creating a low voltage direct current from a high voltage alternating current power supply means.

In particular, it was found according to the teachings of this invention that in a prior known arrangement that utilizes a transformerless capacitor arrangement for creating a low voltage direct current from a high voltage alternating current power supply means to power a microcomputer unit of the control device, the vacuum fluorescent display unit tended to have the figures thereof flutter as the filament means of the display unit is arranged in series with the capacitor of the capacitor arrangement so that the direct current pulsed through the filament means was pulsed at the same frequency as the frequency of the high voltage alternating current power supply means which is approximately 50 to 60 hertz.

Therefore, it was found according to the teachings of this invention that the direct current created by the transformerless capacitor arrangement could be pulsed through the filament means of the display unit by a separate oscillator unit at a greater frequency that causes the filament means to heat to an operating temperature thereof and not experience any adverse figure flutter.

For example, one embodiment of this invention comprises a control device comprising a microcomputer unit, a vacuum fluorescent display unit having filament means, a power supply unit for being interconnected to a high voltage alternating current power supply means that has a certain frequency, and circuit means operatively interconnecting the units together, the power supply unit comprising a transformerless capacitor arrangement for creating a low voltage direct current from the power source means to power the microcomputer unit, the circuit means comprising an oscillator unit that receives the direct current and pulses the same through the filament means at a frequency that is greater than the certain frequency and that causes the filament means to heat to an operating temperature thereof.

Accordingly, it is an object of this invention to provide a new control device having one or more of the novel features of this invention as set forth above or hereinafter shown or described.

Another object of this invention is to provide a new method of making such a control device, the method of this invention having one or more of the novel features of this invention as set forth above or hereinafter shown or described.

Another object of this invention is to provide a new method of operating such a control device, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

BRIEF DESCRIPTION OF THE DRAWINGS

FIG. 5A illustrates part of the control system of this invention.

FIG. 5B illustrates part of the control system of this invention.

FIG. 5C illustrates part of the control system of this invention.

FIG. 5D illustrates part of the control system of this invention.

DESCRIPTION OF THE PREFERRED EMBODIMENTS

Figure 1:
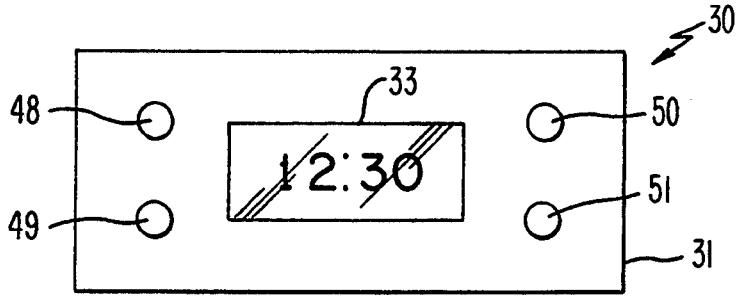
FIG. 1 is a schematic front view of the new control device of this invention.

While the various features of this invention are hereinafter illustrated and described as being particularly adapted to provide a control device having a clock and a timer that controls an audible signal producing means, it is to be understood that the various features of this invention can be utilized singly or in various combinations thereof to provide a control device for controlling other functions as desired.

Therefore, this invention is not to be limited to only the embodiments illustrated in the drawings, because the drawings are merely utilized to illustrate one of the wide variety of uses of this invention.

Figure 2:
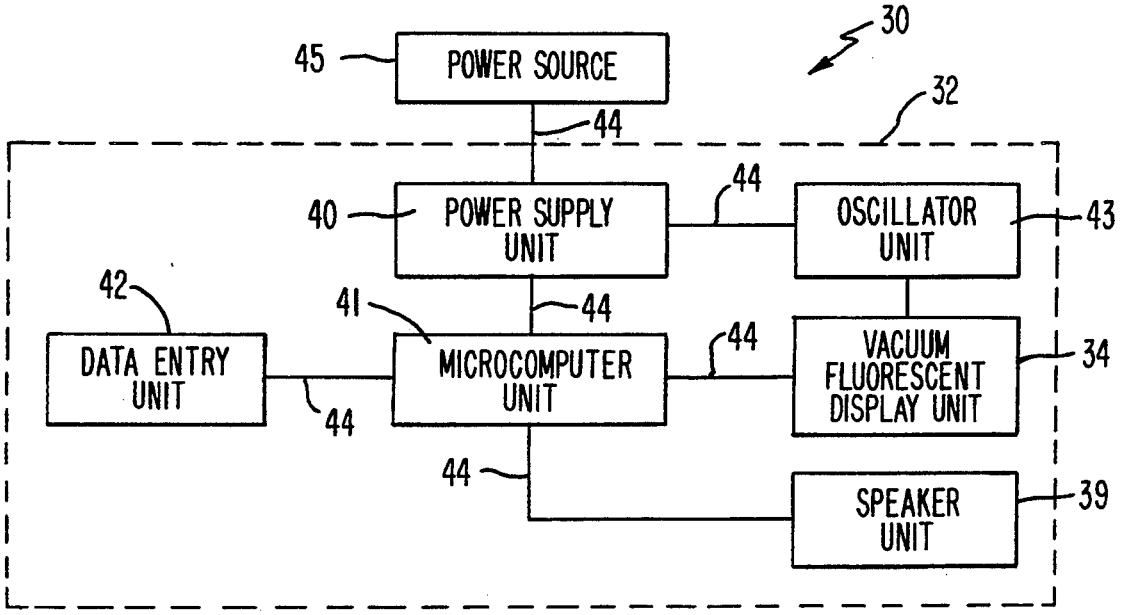
FIG. 2 is a block diagram schematically illustrating the various units of the control device of FIG. 1 and how the same are interconnected together by the circuit means of the control device.
Figure 3:
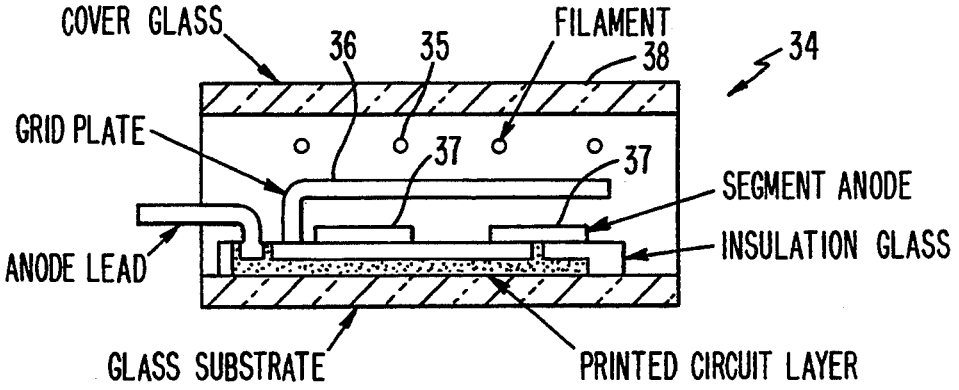
FIG. 3 is a schematic cross-sectional view illustrating the vaccuum fluorescent display unit of the control device of FIGS. 1 and 2.
Figures 4, 5A:
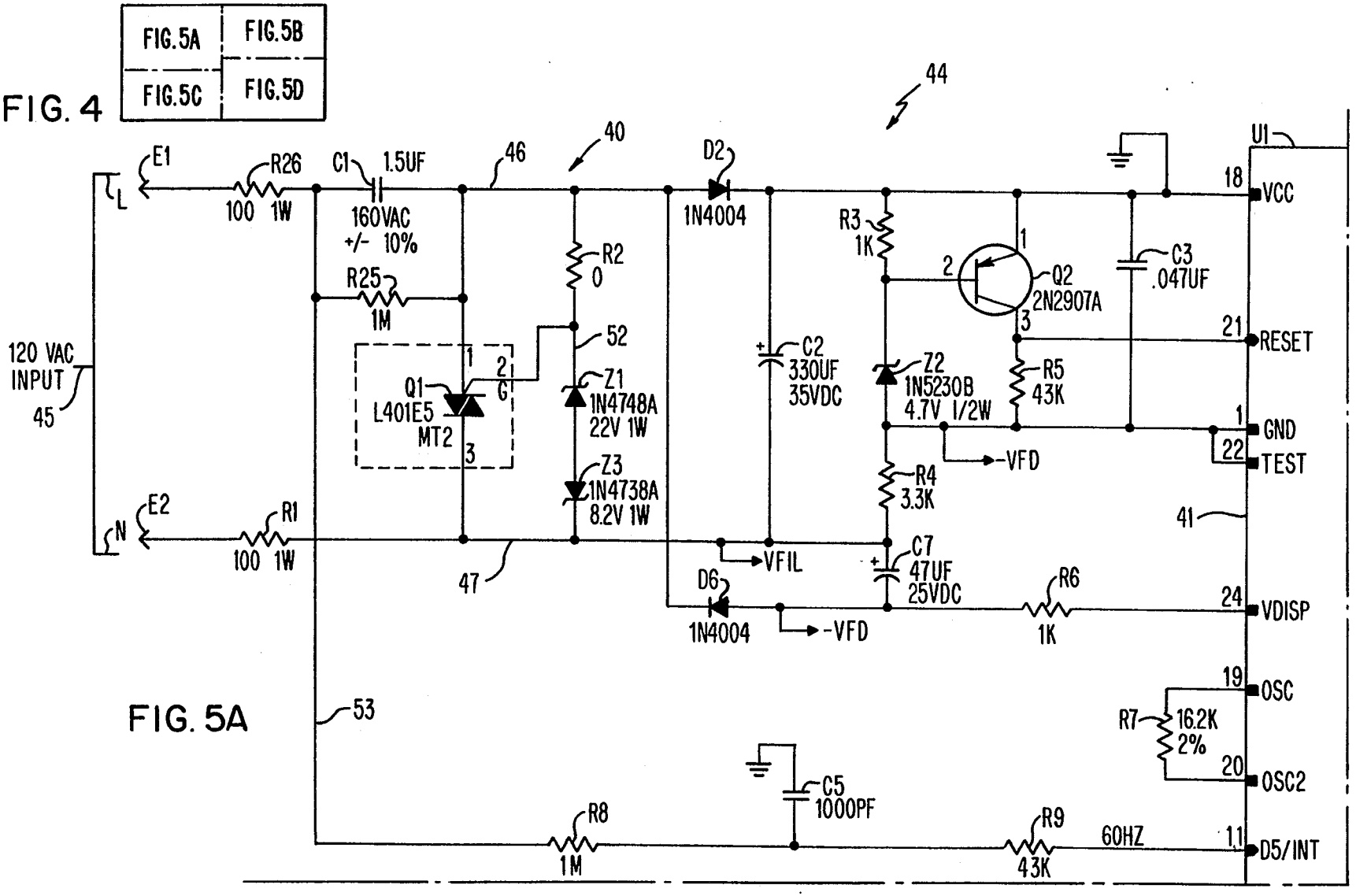
FIG. 4 is a schematic view illustrating how
FIGS. 5A, 5B, 5C and 5D are to be positioned relative to each other in order to illustrate the entire control system of the control device of this invention.
Figure 5B:
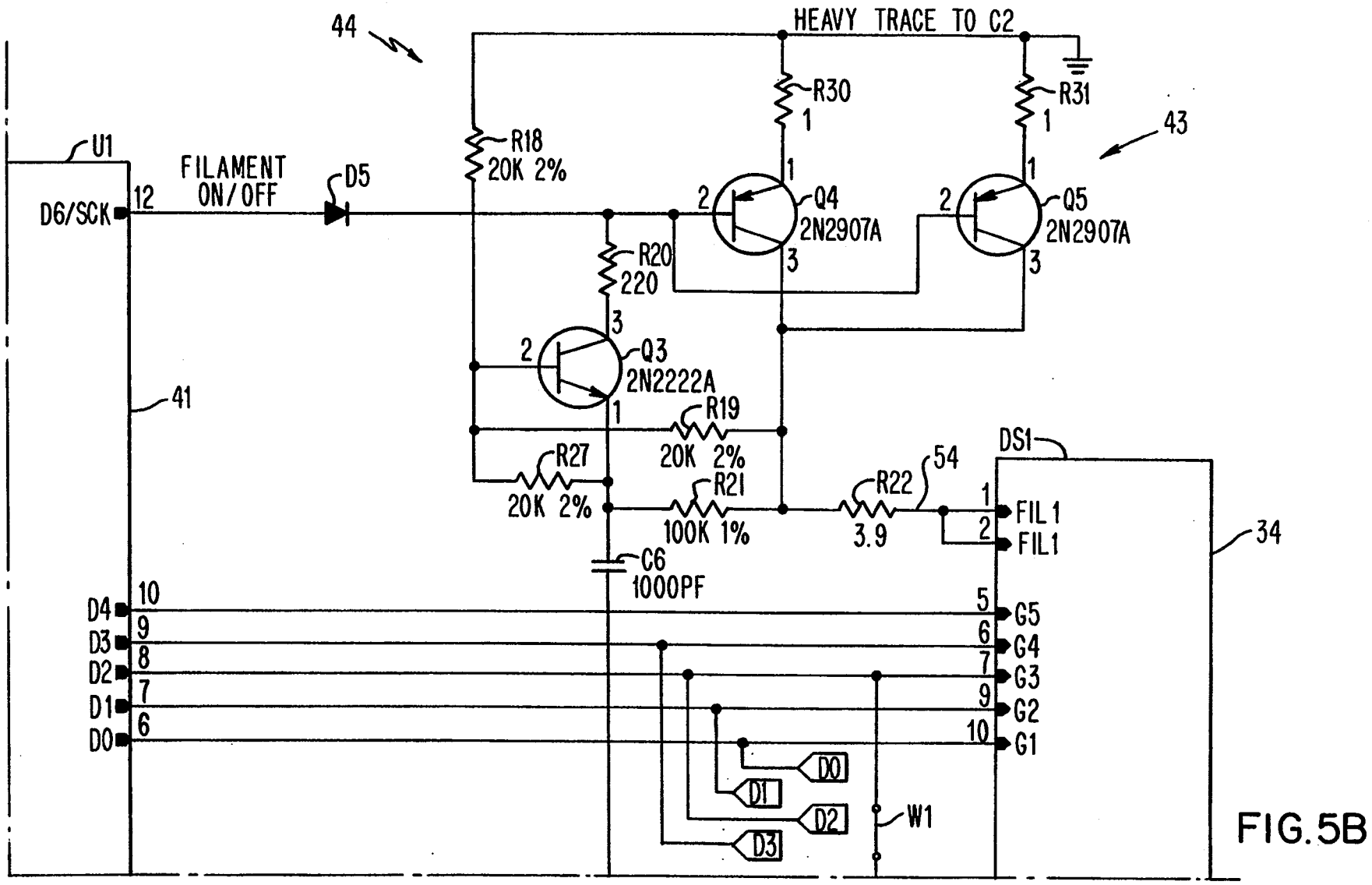
Figure 5C:
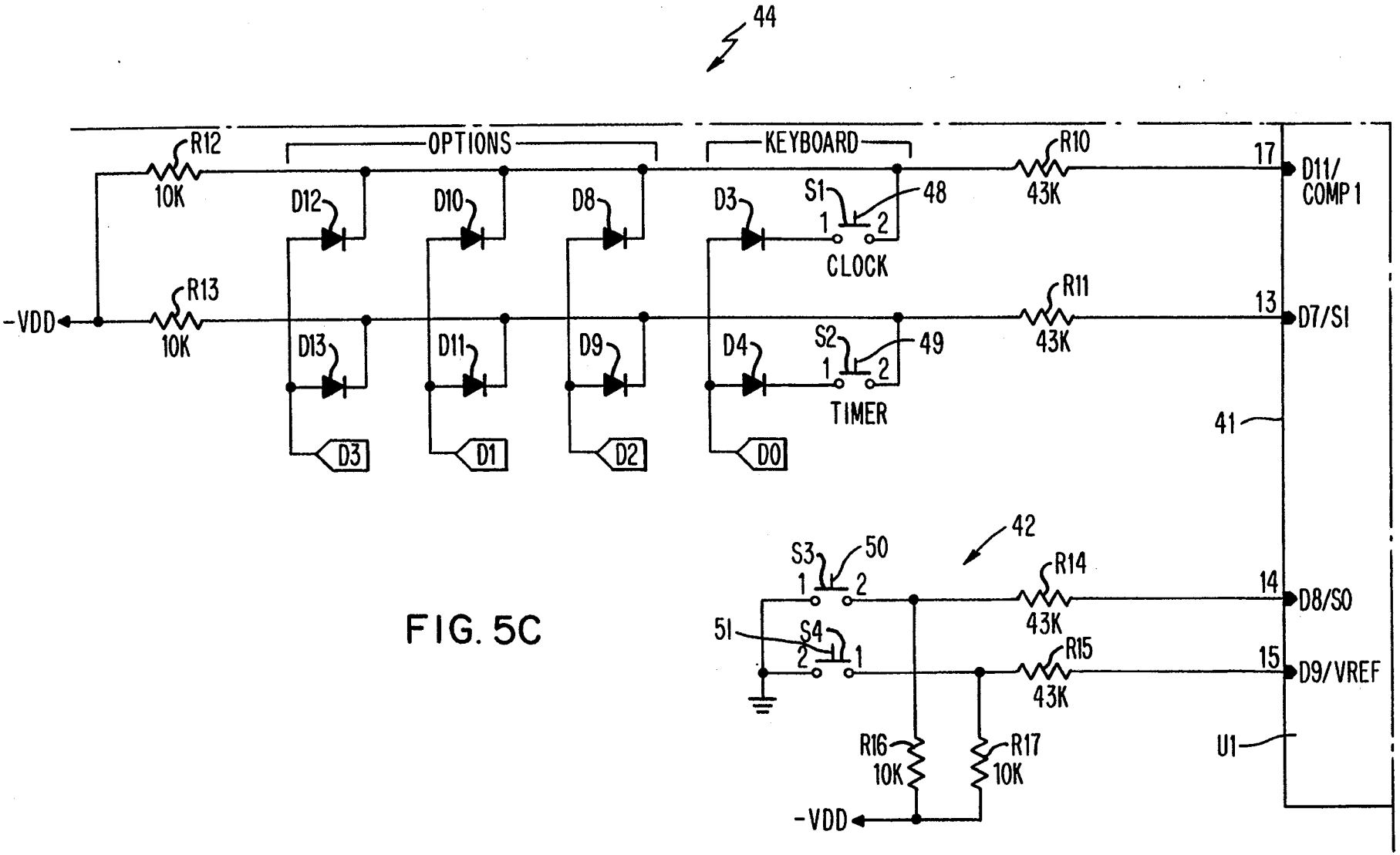
Figures 5D, 8:
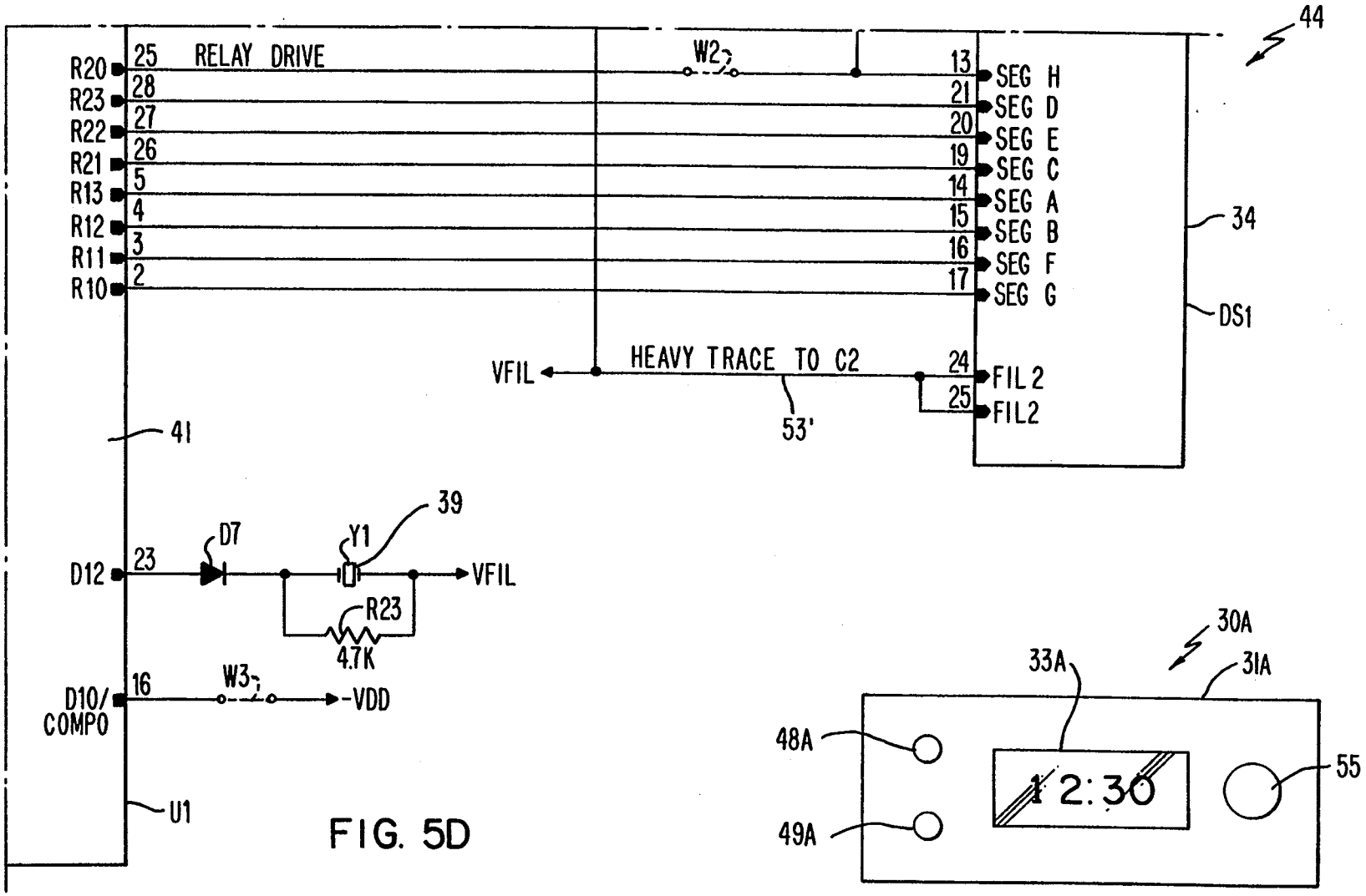
FIG. 8 is a fragmentary view similar to FIG. 1 and illustrates another control device of the invention that utilizes a rotary switch.

Referring now to FIGS. 1 and 2, the new control device of this invention is generally indicated by the reference numeral 30 and comprises a housing means 31 that is illustrated in full lines in FIG. 1 and by a dashed box means 32 in FIG. 2, the housing means 31 having a display window 33 therein for exposing a vacuum fluorescent display unit 34 that is shown in FIG. 1 as indicating the time of day as being 12:30, shown in FIG. 2 as a block 34, shown in FIG. 3 in schematic cross section and shown as reference numeral 34 and reference means DS1 in FIGS. 5B and 5D.

The display unit 34 is conventional in the art and as illustrated in FIG. 3 comprises a filament means 35 that when heated by having an electrical current passed therethrough will emit electrons that pass through a grid plate 36 and collide with fluorescent material of anode segments 37 exciting the same into luminescence with either the proper time of day or the time remaining on a selected time period as the case may be to be viewed through a glass cover 38 at the window 33 of the housing means 31 in a manner well known in the art.

The control device 30 of this invention also functions as a timer wherein a certain amount of time is set into the control device 30 and when the control device 30 has run through such selected time period the control device 30 will sound an alarm, such as by operating a speaker unit 39 that is illustrated as a block in FIG. 2 and by the reference numeral 39 as well as by the reference means Y1 in FIG. 5D.

The control device 30 this invention in addition to the vacuum fluorescent display unit 34 and speaker unit 39 as illustrated in FIG. 2 comprises a power supply unit 40, a microcomputer or microprocessor unit 41, a data entry unit 42 and an oscillator unit 43, the units 34, 39, 40, 41, 42 and 43 being interconnected together by electrical circuit means 44 that is best illustrated in FIGS. 5A–5D.

The power supply unit 40 as illustrated in FIG. 2 is adapted to be interconnected to an external power source 45 by the circuit means 44 and such power source 45 as illustrated in FIG. 5A comprises an 120 volt alternating current source that has terminals L and N adapted to be respectively interconnected to terminals E1 and E2 of the circuit means 44, the terminals E1 and E2 being respectively interconnected to lead means 46 and 47 of the circuit means 44.

The lead means 46 has a resistor R26, a capacitor C1 and a diode D2 in series therein before the lead means 46 interconnects with an inlet port VCC of the microcomputer unit 41 that is also designated U1 in FIGS. 5A–5D.

Figures 6, 7:
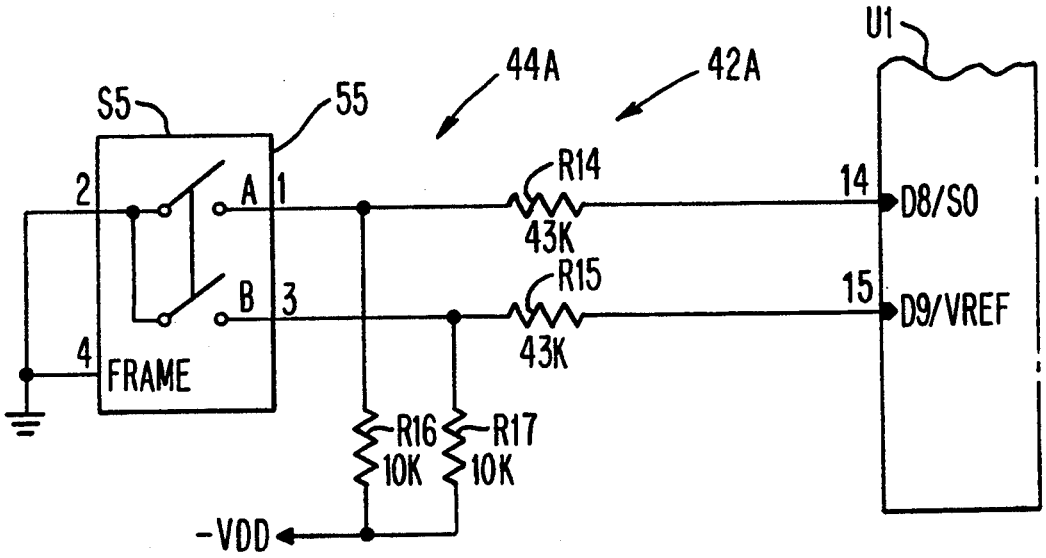
FIG. 6 illustrates a chart indicating how certain of the diodes and/or jumper wires can be utilized in the control system of FIGS. 5A–5D to provide different functions of the clock/timer means.
FIG. 7 is a fragmentary view similar to FIG. 5C illustrating the control system of this invention utilizing a rotary switch rather than the slew control switch means of FIG. 5C.

Unless otherwise specified in FIGS. 5A–5D, all diodes are 1N4148; all capacitor values are 50 V. plus/minus 20%; and all resistor values are in ohms, 0.25 watt plus/minus 5% and it can be seen in the chart of FIG. 6 that certain diodes and certain jumber wires can be left out of the circuit means 44 or be disposed in the circuit means 44 to produce the various options indicated therein. However, since most of the components and the circuitry therefor illustrated in FIGS. 5A–5D are well known in the art, only the parts thereof that are necessary to understand the unique features of the control device 30 of this invention will be hereinafter set forth in detail.

Nevertheless, it can be seen in FIG. 5C that two electrical switches S1 and S2 are respectively provided with push buttons 48 and 49 which when pushed inwardly in FIG. 1 will close the respective switch S1 or S2, the switch S1 being utilized to select the setting of tile time of day clock of the control device 30 and the switch S2 being utilized to select the timer option of the control device 30.

It can also be seen in FIG. 5C that two other electrical switches S3 and S4 are provided and respectively have push buttons 50 and 51 which when pushed inwardly close the respective switches S3 and S4, the switch S3 being utilized to slew up the setting for either the clock or the timer and the switch S4 being utilized to slew down the clock setting or the timer setting as the case may be and in a general manner well known in the art.

Thus, it can be seen that the switches S1, S2, S3 and S4 as well as the circuit means 44 associated therewith comprise the data entry unit 42 of the control device 30 of this invention.

As illustrated in 5A, the power supply unit 40 of the circuit means 44 not only comprises the lead means 46 with the resistor R26, the capacitor C1 and the diode D2, but also the lead 47 that has a resistor R1 therein, a resistor R25 arranged in parallel with the capacitor C1 and a branch lead means 52 between the lead means 46 and 47 and having a resistor R2 therein with zener diodes Z1 and Z3 in series therewith as illustrated.

The circuit means 44 for the power supply unit 40 includes a capacitor C2, a zener diode Z2, resistors R3, R4, R5 and R6, capacitors C3 and C7, diode D6 and transistor Q2 all arranged as illustrated and having the values as indicated.

In addition, a triac Q1 is utilized in the power supply unit 40 as illustrated in FIG. 5A to permit the control device 30 to be utilized with other power source means that have a different voltage and/or frequency such as 50 or 60 hertz, and such as 240 volts, 220 volts or 100 volts rather than the standard house current of 120 volts AC that has a frequency of 50 or 60 hertz.

However, the circuit means 44 when connected to the 120 volt AC source 45 functions in a like manner whether the triac Q1 is in the circuit means 44 or out of the same.

In particular, it can be seen that the power supply unit 40 for the control device 30 is a transformerless capacitor arrangement that limits the AC input voltage from the power source 45 by a series circuit combination of the two resistors R26 and R1, the capacitor C1 and the two zener diodes Z1 and Z3, the two resistors R1 and R26 acting like a fuse if an over-voltage condition should occur. The line capacitor C1 exhibits a capacitive reactance whereby most of the line voltage is dropped across the capacitor C1. The zener diodes Z1 and Z3 are configured as a voltage limiter and regulate the voltage applied to the control device 30 whereby with respect to the anode of the zener diode Z3, the output across the zener limiter is a square wave of +22 and −8.2 volts, the frequency being dependent on the AC line input signal. The +22 volt portion of the square wave signal is passed through the diode D2 and filtered by the capacitor C2 and is used as VCC for powering the microcomputer 41.

The zener diode Z2 produces a +17 voltage level across the resistor R4 with respect to the anode of the zener diode Z3. The 17 volt level is used as −VDD for the system ground reference for all of the MOS circuitry.

The −8.2 volt portion of the input square wave signal is passed through the diode D6 and filtered by the capacitor C7. When referencing −VDD, the system ground, the −8.2 volts adds to the +17 volt level creating −VFD which is the display reference for the microcomputer 41. The supply −VFD is used for the anode and the gate control of the display unit 34. The anode of the zener diode Z3 or as indicated as −VFIL is used as the filament voltage of the display unit 34 in a manner hereinafter described and is approximately −22 volts with respect to VCC.

The reset circuitry for the microcomputer 41 comprises the transistor Q2, the bias resistors R3, R4 and R5 and the zener diode Z2.

The microcomputer 41 monitors the power source 45 by utilizing a line detect circuitry comprising a lead means 53 interconnected to the lead means 46 intermediate the resistor R26 and the capacitor C1 and having resistors R8 and R9 therein and a filter capacitor C5 while being interconnected to the microcomputer input port D5/INT.

The oscillator circuit for the control device 30 consists of an external resistor R7 as illustrated in FIG. 5A, the resistor R7 being used to set the operating frequency for the microcomputer 41 in a manner well known in the art.

The oscillator unit 43 for the control device 30 of this invention is best illustrated in FIG. 5B and comprises transistors Q3, Q4, Q5, capacitor C6, resistors R18, R19, R20, R21, R22, R27, R30 and R31 and diode D5 all arranged by the circuit means 44 as illustrated. Display enable is controlled by the microcomputer 41 as a logic 1 on output pin 12 of the microcomputer 41 will reverse bias the emitter base junctions for both transistors Q4 and Q5 turning the display unit 34 off. Thus, should the microcomputer 41 determine that the power source means 45 ceases to exist by monitoring the same at the input pin D5/INT thereof, the microcomputer 41 will go to logic 1 at pin 12 to turn off the display unit 34 and thereby conserve the energy that was stored in capacitor C2 for the use of power to only the microcomputer 41.

One end means (not shown) of the filament means 35 of the display unit 34 is interconnected to the direct current VFIL by a lead means 53' as illustrated in FIG. 5D while the other end means (not shown) of the filament means 35 is interconnected by a lead means 54 to the transistors Q3, Q4 and Q5 as illustrated in FIG. 5B.

The oscillator unit 43 is adapted to pulse the direct voltage VFIL through the filament means 35 at a high frequency that is greater than the frequency of the power source 45 so as to eliminate any figure flutter at the windows 33 of the control device 30.

In particular, it can be seen that the transistors Q4 and Q5 are connected in parallel and the pulsing current mode for filament heating is controlled by the oscillator circuit of the transistor Q3.

The base oscillating circuit of the transistor Q3 triggers the bases of the transistors Q4 and Q5 for a 1.1 USEC duration at a 47 USEC rate which in turn drives the filament source of the same duration and rate. This is accomplished through a separate charge and discharge path for the capacitor C6.

Initially, with no charge on the capacitor C6, the transistor Q3 will saturate via the resistors R18 and R19 bias, with reference to source −VFIL through the resistor R21 and the filament load. With the transistor Q3 "on" or saturated, the capacitor C6 is charged via the resistors R30 and R31 and the base emitter junctions of the resistors Q4 and Q5, all in series with the resistor R20. The total charge time for the capacitor C6 is approximately 1.1 USEC. As the capacitor C6 charges, the emitter base junction of the transistor Q3 becomes reverse biased forcing the transistor Q3 into cutoff. With the transistor Q3 "off", the discharge path for the capacitor C6 is (the resistor R27 plus the resistor R19) 11 the resistor R21 all in series with the filament load. If power were to be removed, the capacitor C6 would completely discharge. However, because the bias on the base of the transistor Q3 is approximately −10 volts, the transistor Q3 will resaturate when the capacitor C6 discharges to a potential of approximately 0.6 of a volt less than the base bias. This partial discharge requires approximately 47 USEC or one and one-half time constants.

Thus, it can be seen that the filament means 35 will be heated by a high frequency DC pulse therethrough which is at a frequency that exceeds 20 kilohertz so as not to create a human hearing problem and to eliminate the aforementioned figure flutter problem, the DC voltage of −22 volts being applied to lead means 53' at one end means of the filament means 35 being reduced to approximately 2.9 volts through the filament means 35 by the oscillator unit 43 as previously described.

One of the advantages of utilizing the oscillator unit 43 in combination with the transformerless capacitor arrangement of the power supply unit 40 is that the filament means 35 of the display unit 34 is heated from a very stable source of power and the consistency from control unit 30 to control unit 30 of how the temperature to which the filament means is heated is under better control which results in longer life display. Another advantage of this high frequency pulse method is that the display unit 34 has a more attractive appearance because the rapid frequency of the signal does not result in unadvoidable display flicker.

Another advantage is that the control device 30 of this invention has a more protected circuit, i.e., is more removed from any of the problems that can be caused by line transients, lightning strikes and adverse things on the incoming power source 45.

As previously stated, one of the purposes of the triac Q1 in the power supply unit 40 is to get rid of excess energies that may be produced by the power source 45 in a manner that does not produce excessive heat of the control unit 30. The advantage of this is that a simple design is provided without a large heat sink and the control device 30 may be rated to operate in an ambient of 105° C. which is a present standard requirement of the appliance industry.

Also, by utilizing the triac Q1 in the power supply unit 40, the control device 30 could be plugged literally anywhere into any power source in the world and all that would be required is that the resistor R2 be changed to a FK resistor and that the capacitor C1 would have to be appropriately rated to take the highest voltage available so that its voltage rating would have to be appropriate through the highest voltage that it would ever see and on the low end its capacitance value would have to be high enough that it would supply adequate power to operate the control device 30 properly. Once having met that requirement, the triac Q1 would still perform the function of getting rid of any excess energy that the control device 30 does not need and it does so in an efficient manner that does not produce a lot of heat.

It is well known that one desirable characteristic of an electronic control is that if there is a power interruption, the control device does not immediately reset the microprocessor or microcomputer forcing the user to reprogram whatever information may have been in the control device at the time the power died, there being a kind of industry target for setting this for at least 5 seconds or more which supposedly handles a great deal of the typical power interruptions that may occur.

The control device 30 of this invention utilizes the microcomputer 41 to sense when power has been interrupted by monitoring the input pin 11 in which the incoming AC line voltage is being sensed and when the microcomputer 41 detects that the signal is no longer present, the microcomputer 41 forces a logic high on the output pin 12 which is coupled through diode D5 into the base emitter junctions of the transistors Q4 and Q5 to stop the circuit from oscillating immediately and thereby not consuming any more power from that point on. Thus, the energy stored in the capacitor C2 is conserved for use by the microprocessor 41. This greatly extends the time period that the microprocessor 41 can stay alive.

When one desires to set the clock of the control device 32, that person pushes inwardly on the button 48 so as to close the clock switch S1 and then pushes on the button 50 to close the switch S3 and thereby slew up the time setting of the clock of the timer to the desired time thereof. Alternately, the button 51 is pushed inwardly to close the switch S4 to slew down the time on the timer to the desired time.

To set the timer, a person pushes inwardly on the button 49 to close the switch S2 and then pushes in on the button 50 to slew up the timer setting that appears at the display unit 34 until the desired time period is reached. Should a person overshoot the desired time period, the button 50 can be released and then the button 51 pushed inwardly to close the switch S4 and thereby slew down the indicated time period to the desired time period.

Such operation of setting a clock and timer is a procedure well known in the art.

However, instead of using two switches S3 and S4, a single rotary switch can be used for such purpose. For example, reference is now made to FIGS. 7 and 8 wherein another control device 30A of this invention is illustrated and parts thereof that are similar to the parts of the control device 30 are indicated by like reference numerals followed by the reference letter "A".

As illustrated in FIGS. 7 and 8 the control device 30A has a rotary switch S5 that is also designated S5 in FIG. 7 and is utilized to increase the indicated time when rotated in one direction or decrease the indicated time when rotated in the other direction in a manner well known in the art. For example, see the Fowler U.S. Pat. No. 4,777,483, whereby this U.S. patent is being incorporated into this disclosure by this reference thereto whereby a further discussion of the operation of the rotary switch S5 is deemed unnecessary.

In view of the above, it can be seen that this invention not only provides a new control device, but also this invention provides a new method of making such a control device and a new method of operating such a control device.

While the forms and methods of this invention now preferred have been illustrated and described as required by the patent statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the patent statute.

What is claimed is:

1. In a control device comprising a microcomputer unit, a vacuum fluorescent display unit having filament means, a power supply unit for being interconnected to a high voltage alternating current power supply means that has a certain frequency, and circuit means operatively interconnecting said units together, said power supply unit comprising a transformerless capacitor arrangement for creating a low voltage direct current from said power source means to power said microcomputer unit, the improvement wherein a part of said circuit means comprises a transformerless oscillator unit that receives said direct current and pulses the same through said filament means at a frequency that is greater than said certain frequency and that causes said filament means to heat to an operating temperature thereof.

2. A control device as set forth in claim 1 wherein said microcomputer unit has means to monitor said power source means and to turn off said oscillator unit if said power source means terminates its supply of said alternating current to said power supply unit.

3. A control device as set forth in claim 1 wherein said certain frequency is approximately 60 hertz.

4. A control device as set forth in claim 3 wherein said oscillator unit pulses said direct current through said filament means with a frequency of approximately 20 kilohertz.

5. In a control device comprising a microcomputer unit, a vacuum fluorescent display unit having filament means, a power supply unit for being interconnected to a high voltage alternating current power supply means that has a certain frequency, and circuit means operatively interconnecting said units together, said power supply unit comprising a transformerless capacitor arrangement for creating a low voltage direct current from said power source means to power said microcomputer unit, the improvement wherein a part of said circuit means comprises an oscillator unit that receives said direct current and pulses the same through said filament means at a frequency that is greater than said certain frequency and that causes said filament means to heat to an operating temperature thereof, said microcomputer unit having means to monitor said power source means and to turn off said oscillator unit if said power source means terminates its supply of said alternating current to said power supply unit, said filament means having opposed end means one of which is interconnected by said circuit means to one side of said direct current, said oscillator unit comprising a pair of transistors each having a base emitter junction and being connected in parallel between the other of said end means of said filament means and the other side of said direct current, a capacitor having opposed sides, and an oscillator transistor connected between said base emitter junctions of said pair of transistors and one of said sides of said capacitor, said capacitor having the other of said sides connected by said circuit means to said one side of said direct current.

6. A control device as set forth in claim 5 wherein said means of said microcomputer comprises an output port that is connected by said circuit means to said base emitter junctions of said pair of transistors.

7. In a method of making a control device comprising a microcomputer unit, a vacuum fluorescent display unit having filament means, a power supply unit for being interconnected to a high voltage alternating current power supply means that has a certain frequency, a circuit means operatively interconnecting said units together, said power supply unit comprising a transformerless capacitor arrangement for creating a low voltage direct current from said power source means to power said microcomputer unit, the improvement comprising the step of forming a part of said circuit means to comprise a transformerless oscillator unit that receives said direct current and pulses the same through said filament means at a frequency that is greater than said certain frequency and that causes said filament means to heat to an operating temperature thereof.

8. A method of making a control device as set forth in claim 7 and comprising the step of forming said microcomputer unit to have means to monitor said power source means and to turn off said oscillator unit if said power source means terminates its supply of said alternating current to said power supply unit.

9. A method of making a control device as set forth in claim 7 wherein said certain frequency is approximately 60 hertz.

10. A control device as set forth in claim 9 and comprising the step of forming said oscillator unit to pulse said direct current through said filament means with a frequency of approximately 20 kilohertz.

11. In a method of making a control device comprising a microcomputer unit, a vacuum fluorescent display unit having filament means, a power supply unit for being interconnected to a high voltage alternating current power supply means that has a certain frequency, a circuit means operatively interconnecting said units together, said power supply unit comprising a transformerless capacitor arrangement for creating a low voltage direct current from said power source means to power said microcomputer unit, the improvement comprising the steps of forming a part of said circuit means to comprise an oscillator unit that receives said direct current and pulses the same through said filament means at a frequency that is greater than said certain frequency and that causes said filament means to heat to an operating temperature thereof, forming said microcomputer unit to have means to monitor said power source means and to turn off said oscillator unit if said power source means terminates its supply of said alternating current to said power supply unit, forming said filament means to have opposed end means one of which is interconnected by said circuit means to one side of said direct current, forming said oscillator unit to comprise a pair of transistors each having a base emitter junction and being connected in parallel between the other of said end means of said filament means and the other side of said direct current, a capacitor having opposed sides, and an oscillator transistor connected between said base emitter junctions of said pair of transistors and one of said sides of said capacitor, and forming said capacitor to have the other of said sides connected by said circuit means to said one side of said direct current.

12. A method of making a control device as set forth in claim 11 and comprising the step of forming said means of said microcomputer to comprise an output port that is connected by said circuit means to said base emitter junctions of said pair of transistors.

* * * * *